US005117621A

United States Patent [19]

Feichtinger et al.

[11] Patent Number: 5,117,621

[45] Date of Patent: Jun. 2, 1992

[54] SYSTEM FOR CUTTING ROVING IN A SPINNING MACHINE

[75] Inventors: Gustay Feichtinger, Süssen; Hans-Peter Weeger, Hattenhofen, both of Fed. Rep. of Germany

[73] Assignee: Zinser Textilmaschinen GmbH, Ebersbach/Fils, Fed. Rep. of Germany

[21] Appl. No.: 584,749

[22] Filed: Sep. 18, 1990

[30] Foreign Application Priority Data

Sep. 18, 1989 [DE] Fed. Rep. of Germany ..... 3931124

[51] Int. Cl.[5] ..... D01H 7/24; D01H 7/46

[52] U.S. Cl. ..... 57/278; 57/115; 57/264; 57/276; 57/278; 57/299

[58] Field of Search ..... 57/115-116, 57/264, 276, 267, 278, 281, 299

[56] References Cited

U.S. PATENT DOCUMENTS

| | | | |
|---|---|---|---|
| 806,016 | 11/1905 | Spence | 57/115 |
| 3,643,415 | 2/1972 | Mackie | 57/117 |
| 3,681,905 | 8/1972 | Furtmeier et al. | 57/299 |
| 4,015,416 | 4/1977 | Mori et al. | 57/278 |
| 4,196,575 | 4/1980 | Novak | 57/267 |
| 4,313,299 | 2/1982 | Gunkinger et al. | 57/267 |
| 4,870,815 | 10/1989 | Marchiori et al. | 57/299 |

FOREIGN PATENT DOCUMENTS 308215 9/1987 European Pat. Off. .

*Primary Examiner*—Daniel P. Stodola
*Assistant Examiner*—William Stryjewski
*Attorney, Agent, or Firm*—Herbert Dubno; Andrew Wilford

[57] ABSTRACT

A spinning apparatus winds a strand onto a yarn package by relatively rotating a flyer and the yarn package about an upright axis so as to wind the strand in a succession of turns around the package by a flyer finger movable axially relative to the package. Each successive layer of turns is shorter than the preceding one so that the finished package has an axially upwardly tapered upper end. After substantially completely forming the package the rotation is generally stopped to leave the flyer in a position with the finger below the upper end of the last layer of turns formed on the package. Then the package and finger are relatively axially moved until the finger is generally at the upper end of the first layer of turns formed on the package. The flyer and package are then relatively rotated forward, that is in the same direction as when the package was being formed, through at least one half revolution about the axis so as to form a loop of the strand around the upper package end. Slack is then created in the strand upstream of the package and the finger is moved downward below the level of the upper end of the outer layer. Finally the strand is cut below the level of the upper end of the outer layer.

6 Claims, 2 Drawing Sheets

SYSTEM FOR CUTTING ROVING IN A SPINNING MACHINE

FIELD OF THE INVENTION

The present invention relates to a system for cutting roving in a prespinning machine. More particularly this invention concerns cutting the strand after a yarn package or the like has been fully wound up and preparatory to loading a new spool on the spinning machine for winding up a new yarn package, that is cutting between the finished package and the applicator finger of the flyer.

BACKGROUND OF THE INVENTION

When a roving package is unloaded from a flyer-type spinner the roving is cut and a tail is left hanging from the guide or applicator finger of the flyer. The trailing end is pressed against the package so that it clings there and with luck does not come loose as the package is moved off to the next production step. The strand tail dangling from the guide finger is pressed against the side of the next spool loaded into the flyer for forming the next package. During the winding operation the flyer reciprocates vertically through a continuously shorter stroke so as to form on the spool successive layers each slightly shorter than the underlying one, giving the finished package frustoconically tapered upper and lower ends.

Long fiber material such as wool and wool blends resist separation with substantial force since the roving is held with some pressure by the finger against the spool and there is substantial friction between adjacent turns of the strand. In addition there is no way to guarantee that the trailing end of the winding lies on the upper tapered end of the yarn package.

OBJECTS OF THE INVENTION

It is therefore an object of the present invention to provide an improved system for cutting the slubbing or roving at the end of forming a yarn package that leaves the trailing strand end on the upper tapered end of the yarn package.

SUMMARY OF THE INVENTION

A spinning apparatus winds a strand onto a yarn package by relatively rotating a flyer and the yarn package about an upright axis so as to wind the strand in a succession of turns around the package by a flyer finger movable axially relative to the package. Each successive layer of turns is shorter than the preceding one so that the finished package has an axially upwardly tapered upper end. After substantially completely forming the package the rotation is generally stopped to leave the flyer in a position with the finger below the upper end of the last layer of turns formed on the package. Then the package and finger are relatively axially moved until the finger is generally at the upper end of the first layer of turns formed on the package. The flyer and package are then relatively rotated forward, that is in the same direction as when the package was being formed, through at least one half revolution about the axis so as to form a loop of the strand around the upper package end. Slack is then created in the strand upstream of the package and the finger is moved downward below the level of the upper end of the outer layer. Finally the strand is cut below the level of the upper end of the outer layer.

This procedure forms a loop of the trailing end of the strand on the full package that is engaged over the small-diameter upper end of the package. In this position the strand is quite stable and there is no meaningful chance of the package unwinding when transported away hanging from a standard carrier. The roving strand is fully accessible at the next treatment step, normally further spinning and/or twisting, so that subsequent handling is easy.

According to a further feature of this invention in the looping step the package is rotated through plural revolutions. This forms a very stable group of loops or turns around the upper package end making any unwinding impossible.

Slack is created in the strand after forming the loop by feeding additional strand to the package. Normally the flyer is stopped in a position with the finger close underneath the upper end of the last layer of turns formed on the package and after moving it up it is again stopped when the finger is close underneath the upper end of the first layer of turns formed on the package.

To prevent the flyer snagging on the package as it is moved up, according to this invention the finger has an outwardly turned end.

DESCRIPTION OF THE DRAWING

The above and other objects, features, and advantages will become more readily apparent from the following, reference being made to the accompanying drawing in which.

SPECIFIC DESCRIPTION

Figure 1:
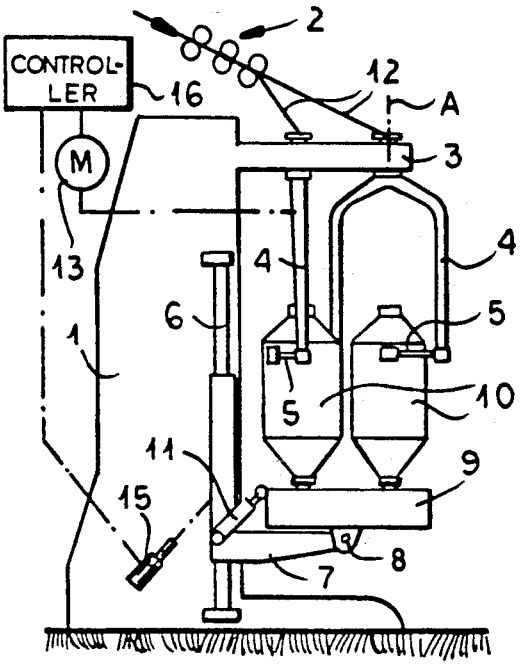
FIGS. 1 through 5 are mainly diagrammatic side views illustrating successive steps of the method of this invention.

As seen in FIGS. 1 through 5 a frame 1 of a preparatory spinning or roving machine has a drawing frame 2 feeding a bank 3 of flyers 4 that are suspended centered on respective vertical axes A of respective yarn packages 10. Each flyer 4 is hollow and has a respective presser-type applicator or guide finger 5 through which a roving strand 12 is fed to the respective package 10.

The frame 1 is provided with a vertical guide 6 on which a support 7 is vertically displaceable. The packages 10 are carried on a base 9 pivotal about a horizontal axis 8 on the support 7, and a small hydraulic or pneumatic ram 11 is provided to effect the desired angular positioning for unloading and loading the base 9. A drive motor indicated schematically at 13 can rotate the flyers 4 and an actuator indicated schematically at 15 can vertically move the base 9 to relatively axially displace the flyers 4 and the respective packages 10. A controller 16 operates both drive means 13 and 15. The controller 16 shortens the vertical stroke of the packages 10 with each stroke so that the strand 12 is wound on them in turns forming successive layers which each are shorter at both top and bottom than the underlying layers and the resultant package has the illustrated frustoconically shaped upper and lower ends.

Once a package is finished the drive 13 for the flyers 4 is stopped with the fingers 5 in positions just below the upper ends or turnaround locations for the last layer of turns wound onto the package. This is the position shown in FIG. 1. In this position the rotation of the packages 10 either stops completely or slows to a virtual standstill.

Figure 2:
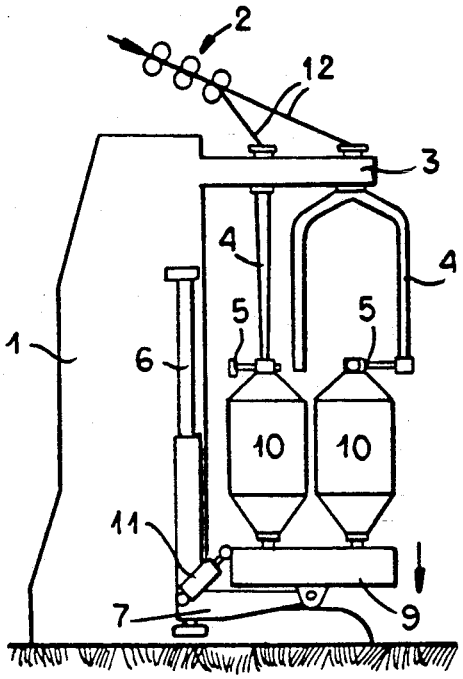

Then as seen in FIG. 2 the packages 10 are lowered until the fingers 5 are in a position immediately below the upper end of the first layer of the strand 12 wound on them. In this position the fingers 5 are well above the upper ends of the outermost turn layers and all rotation of the packages 10 has stopped.

Figure 3:
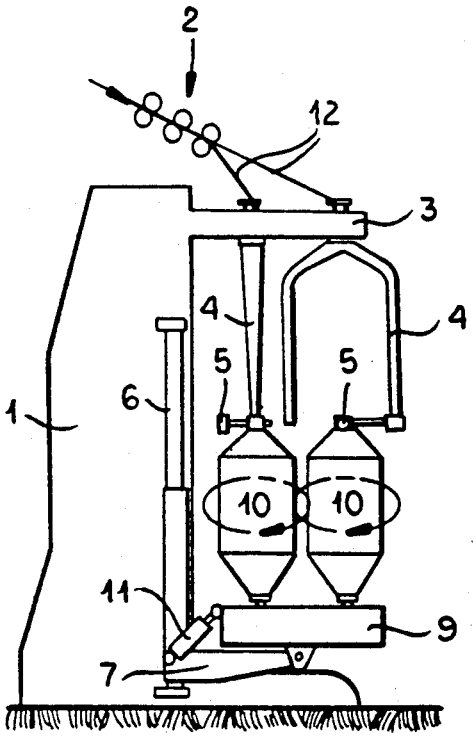
Figure 4:
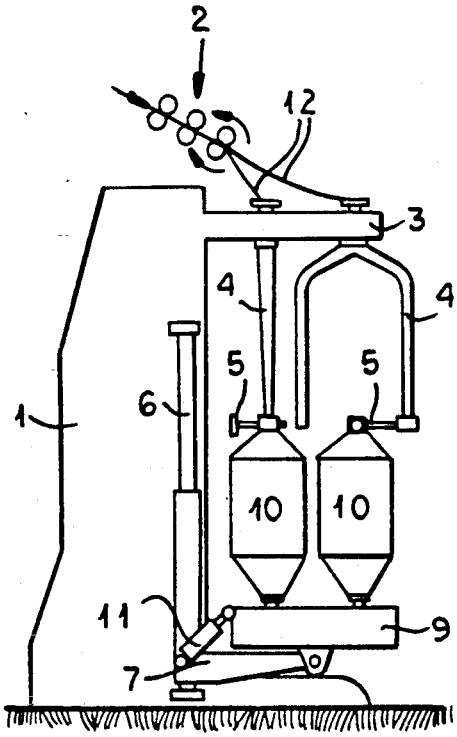
Figure 5:
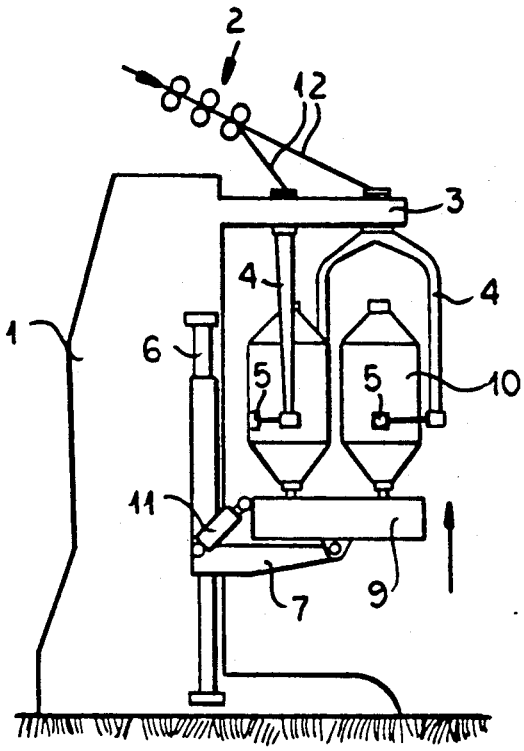

Then as shown in FIG. 3 the packages are rotated through at least 180°, or even through several revolutions. Slack is created in the strands 12 as shown in FIG. 4 by means of the drawing frame 2, and finally as shown in FIG. 5 the packages 10 are raised by the drive 15 to move the fingers 5 down below the upper level of the outermost layer and the strand 12 is cut. The slack created in the strands 12 prevents such movement from pulling the loops down.

Figure 6:
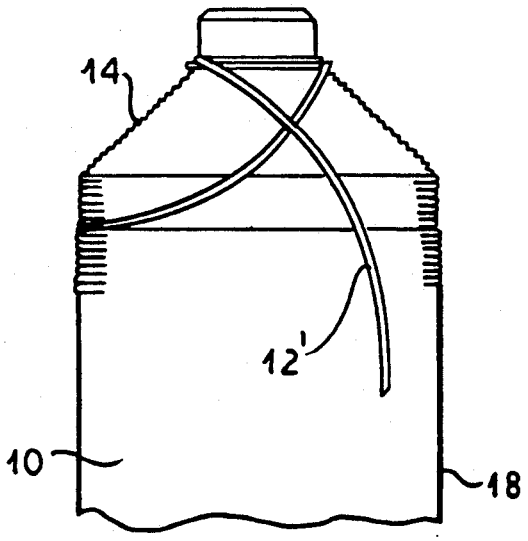
FIG. 6 is larger-scale side view of the upper portion of a yarn package with its trailing strand end tied off according to this invention.
Figure 7:
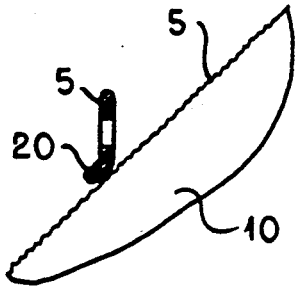
FIG. 7 is a schematic sectional view through the applicator or guide finger applied against the upper tapered package end.

This forms on the packages as shown in FIG. 6 one or more loops about the upper small-diameter end 14, with a tail 12' of the filament hanging down over an outer layer 18. FIG. 7 shows how the lower end 20 of the eye of the finger 5 through which the strand 12 passes is bent out to prevent it from snagging on the package and to prevent the strand 12 from becoming unthreaded from it.

We claim:

1. A method of operating a spinning apparatus for winding a strand onto a yarn package wherein a flyer and the package are relatively rotated in a forward direction about an upright axis and the strand is wound in a succession of turns around the package from a radial innermost first layer to a radial outermost last layer by a flyer finger movable axially relative to the package and wherein each successive layer of turns has an upper end and is shorter than the preceding layer so that the finished package has an axially upwardly tapered upper end and the upper end of the last layer is below the upper end of the first layer, the method comprising the steps after substantially completely forming the package of sequentially:

a) stopping the drive for the relative rotation of the flyer and the package about the axis and allowing the flyer to stop in a position with the finger close underneath the upper end of the last layer of turns formed on the package;

b) relatively axially moving the package and the finger until the finger is at the upper end of the first layer of the turns formed on the package and above the upper end of the last layer of the turns;

c) relatively rotating the flyer and the package in the forward direction through at least one half revolution about the axis and thereby forming a loop of the strand around the upper package end above the upper end of the last layer of the turns;

d) creating slack in the strand upstream of the package; and e) downwardly moving the finger.

2. The operating method defined in claim 1 wherein in step c) the package is rotated through plural revolutions.

3. The operating method defined in claim 1 wherein slack is created in step d) by feeding additional strand to the package.

4. A method of operating a spinning apparatus for winding a strand onto a yarn package wherein the yarn package is rotated in a forward direction about an upright axis and the strand is wound in a succession of turns around the package from the radial innermost first layer to a radial outermost last layer by a flyer finger movable axially relative to the package and wherein each successive layer of turns is shorter than the preceding one and has an upper end so that the finished package has an axially upwardly tapered upper end and the upper end of the last layer is below the upper end of the first layer, the method comprising the steps after substantially completely forming the package of sequentially:

a) stopping the drive for the yarn package and allowing same to generally stop rotating in a position with the finger close underneath the upper end of the last layer of turns formed on the package;

b) relatively axially moving the package and the finger until the finger is close underneath the upper end of the first layer of the turns formed on the package and above the upper end of the last layer of the turns;

c) rotating the package in the forward direction through at least one half revolution about the axis and thereby forming a loop of the strand around the upper package end above the upper end of the last layer of turns;

d) creating slack in the strand upstream of the package;

e) downwardly moving the finger; and f) cutting the strand below the level of the upper end of the last layer of turns.

5. An apparatus for winding a strand onto a yarn package, the apparatus comprising:

a flyer centered on an upright axis above a yarn package and having a finer through which the strand is fed to the package;

drive means for relatively rotating the package and the flyer forward about the axis and thereby forming a succession of turns of the strand on the package from a radial innermost first layer to a radial outermost last layer with each layer having an upper end;

means for axially moving the finger relative to the package in vertical strokes of decreasing length to wind on the package successively shorter layer of turns and to impart to the package an axially upwardly tapered upper end with the upper end of the last layer below the upper end of the first layer; and control means for a) stopping the drive means or the package and allowing same to generally stop rotating in a position with the finger underneath the upper end of the last layer of turns formed on the package;

b) relatively axially moving the package and the finger until the finger is at the upper end of the first layer of turns formed on the package and above the upper end of the last layer of turns;

c) rotating the package forward through at least one half revolution about the axis and thereby forming a loop on the upper package end above the upper end of the last layer of turns;

d) creating slack in the strand upstream of the package; and e) downwardly moving the finger.

6. The apparatus defined in claim 5 wherein the finger has an end turned radially outwardly relative to the axis.

* * * * *